US008144014B1

(12) United States Patent
Yang

(10) Patent No.: US 8,144,014 B1
(45) Date of Patent: Mar. 27, 2012

(54) INFRARED ELECTRONIC ARTICLE SURVEILLANCE SYSTEM WITH DYNAMIC PASSCODE PROTECTION

(75) Inventor: Xiao Hui Yang, Los Altos, CA (US)

(73) Assignee: WG Security Products, San Jose, CA (US)

( * ) Notice: Subject to any disclaimer, the term of this patent is extended or adjusted under 35 U.S.C. 154(b) by 226 days.

(21) Appl. No.: 12/391,222

(22) Filed: Feb. 23, 2009

Related U.S. Application Data

(60) Provisional application No. 61/030,932, filed on Feb. 22, 2008, provisional application No. 61/030,929, filed on Feb. 22, 2008.

(51) Int. Cl.
*G08B 13/14* (2006.01)

(52) U.S. Cl. ..... 340/572.1; 340/556; 340/568.1

(58) Field of Classification Search ..... 340/568.4, 340/568.2, 572.1, 572.4, 572.8, 5.9, 10.1, 340/540, 541, 555, 556, 572.7, 568.1; 235/385, 235/492
See application file for complete search history.

(56) References Cited

U.S. PATENT DOCUMENTS

| | | | | |
|---|---|---|---|---|
| 5,105,190 | A | 4/1992 | Kip et al. | |
| 5,151,684 | A | 9/1992 | Johnsen | |
| 5,469,363 | A | 11/1995 | Saliga | |
| 5,874,896 | A | 2/1999 | Lowe et al. | |
| 5,874,902 | A | 2/1999 | Heinrich et al. | |
| 5,955,951 | A | 9/1999 | Wischerop et al. | |
| 6,104,333 | A | 8/2000 | Wood, Jr. | |
| 6,137,414 | A | 10/2000 | Federman | |
| 6,265,963 | B1 | 7/2001 | Wood, Jr. | |
| 6,753,759 | B2 | 6/2004 | Stegmaier et al. | |
| 6,864,792 | B2 | 3/2005 | Labit et al. | |
| 7,005,968 | B1 | 2/2006 | Bridgelall | |
| 7,098,792 | B1 | 8/2006 | Ahlf et al. | |
| 7,295,114 | B1 | 11/2007 | Drzaic et al. | |
| 7,394,376 | B1 * | 7/2008 | Sayegh et al. | 340/572.1 |
| 2002/0158762 | A1 * | 10/2002 | Nguyen et al. | 340/572.9 |
| 2004/0145477 | A1 * | 7/2004 | Easter et al. | 340/572.3 |
| 2005/0104733 | A1 | 5/2005 | Campero | |
| 2005/0270155 | A1 * | 12/2005 | Sayegh | 340/572.1 |
| 2007/0080806 | A1 | 4/2007 | Lax et al. | |

* cited by examiner

*Primary Examiner* — Anh V La
(74) *Attorney, Agent, or Firm* — Waters Law Group, PLLC; Robert R. Waters; Brian W. Foxworthy

(57) ABSTRACT

An electronic article surveillance system utilizing infrared communication is disclosed wherein added security is obtained by using dynamic passcode protection. The system includes tags, deactivators, a base control system and perhaps one or more remote management stations. Each tag, base station, remote station and deactivator includes an accurate clock generator, a microprocessor, infrared communication capabilities, and machine readable instructions encoded for performing an algorithm for generating multiple passcodes. At a specified time, each active tag possesses a changeable passcode. The base station further includes infrared communication capabilities with an infrared communication path between each tag and each base station, the path enabling interchange of information between each tag and each base station. Each tag replaces the passcode at a specified interval, or at a specified point in time.

28 Claims, 10 Drawing Sheets

INFRARED ELECTRONIC ARTICLE SURVEILLANCE SYSTEM WITH DYNAMIC PASSCODE PROTECTION

CROSS REFERENCE TO RELATED APPLICATIONS

This application claims priority from U.S. Provisional Application 61/030,932, filed on Feb. 22, 2008, and U.S. Provisional Application 61/030,929 filed on Feb. 22, 2008, and the teachings in the specifications for these provisional applications are incorporated herein by reference.

FIELD OF INVENTION

The present application is generally related to an electronic article surveillance (EAS) system, and more specifically, an EAS system utilizing tags and deactivators featuring infrared communication for deactivation and alarming, and featuring dynamic time-based passcode modification, and other tamper resistant features.

MOTIVATION OF THE INVENTOR

A. Description of the State of the Art

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In order to make an EAS system effective, one must consider how to make the EAS tags tamper resistant. This is an on-going effort, because over time, thieves become more clever in learning how to tamper with an EAS tag such as to defeat it. The retailer (and the tag manufacturer) must consider how to detect and prevent tampering with the tags. The particular construction of a tag will determine how tampering is detected.

Although an assortment of attachment mechanisms are available in the prior art, one of the more common and more successful attachment mechanisms is an EAS hard tag, consisting of a tack which is used to physically pin the protected article to the EAS tag base. The tag base is usually constructed of a hard and durable plastic and is generally in the neighborhood of three inches long. The tag serves as a housing for an electronic signal generation means secured within the housing, and which is designed to be immune to tampering. A cap on the tack keeps the tag attached to the article.

Other tags, or transponders, use a lanyard construction. One end of the lanyard is fixed in the transponder and the other end is capable of being inserted into an aperture in the transponder where it can be retained by the transponder. The lanyard can pass through an aperture on the article to be protected or may be placed around an article in a position where it cannot be simply slid off the article. The lanyard is typically constructed of material that is very difficult to break or cut, but yet, is easy to bend into place.

A common device for releasably retaining both tack shafts and lanyard ends is a ball clutch mechanism. The ball clutch mechanism may be constructed to release the retained item after application of a strong magnetic force. Other clips and clamps may also be used. Other types of tags may employ vials of ink, which may break if the tag is physically bent, thereby destroying the benefit of the theft attempt.

B. The Need for Improvement

Although EAS systems have been used effectively for many years, the retail landscape has been challenged by thieves that are becoming ever more sophisticated. For example, a sophisticated thief may learn how to defeat a ball clutch mechanism by carrying into a store a strong magnet similar to the magnet used to remove the tags at the check-out counter. A sophisticated thief can use devices designed to determine the algorithm of the deactivation devices or tags in order to jam the operation of the tag. A sophisticated thief may have a means for determining passcodes for the system by espionage or by breaching electronic security codes. Furthermore, a large amount of theft (or shrinkage) results from an "inside job" by dishonest employees, who may have access to passcodes and the like. Therefore, the need exists in the marketplace for an EAS system that is dynamic such that key passcode coding and the like may be quickly or even randomly changed. Thus, a need has been demonstrated for an EAS system and method for an EAS system that can be dynamically changed to foil sophisticated theft attempts. Additionally, a need has been expressed for an EAS technology based upon infrared technology to enable real time code changing to be economically viable. As such, the present application discloses a system and a method by which these and other objects are achieved.

SUMMARY

This application generally discloses an electronic article surveillance system utilizing infrared technology to protect retail merchandise. The system utilizes infrared technology to affect a system in which time-based passcode coding may be easily changed to create greater security and less capability for the system to be compromised.

In one embodiment, an electronic article surveillance system comprises at least one tag. Each tag comprises an accurate clock generator, a microprocessor, infrared communication capabilities, and machine readable instructions encoded for performing an algorithm for generating multiple passcodes. At a specified time, each active tag possesses a passcode. In at least one embodiment, all of the tags in a given location or vicinity have the same changeable passcode at any given time. The EAS system is further characterized by at least one base station, each base station comprising an accurate clock generator, a processor, machine readable instructions encoded for performing an algorithm generating multiple passcodes. The base station further includes infrared communication capabilities with an infrared communication path between each tag and each base station, the path enabling interchange of information between each tag and each base station. Each tag replaces the passcode at a specified interval, or at a specified point in time.

In another embodiment, an electronic article surveillance system comprises: at least one tag, each tag comprising an accurate clock generator, a microprocessor, infrared communication means, and machine readable instructions encoded for performing an algorithm for generating multiple passcodes, and wherein at a specific time, each active tag possesses a passcode; at least one base station, each base station comprising an accurate clock generator, a processor, and machine readable instructions encoded for performing an algorithm for generating multiple passcodes; at least one remote for remotely detecting information and programming additional information; an infrared communication path between each tag, each base station and each remote, the path enabling interchange of information between each tag and each base station; wherein each tag replaces the passcode at a specified time.

A person of ordinary skill in the art would understand how to incorporate the improvements described herein into a conventional EAS system.

BRIEF DESCRIPTION OF THE DRAWINGS

Additional utility and features of the invention will become more fully apparent to those skilled in the art by reference to the following drawings, which illustrate some of the primary features of preferred embodiments.

DESCRIPTION OF THE EMBODIMENT(S)

Figure 1:
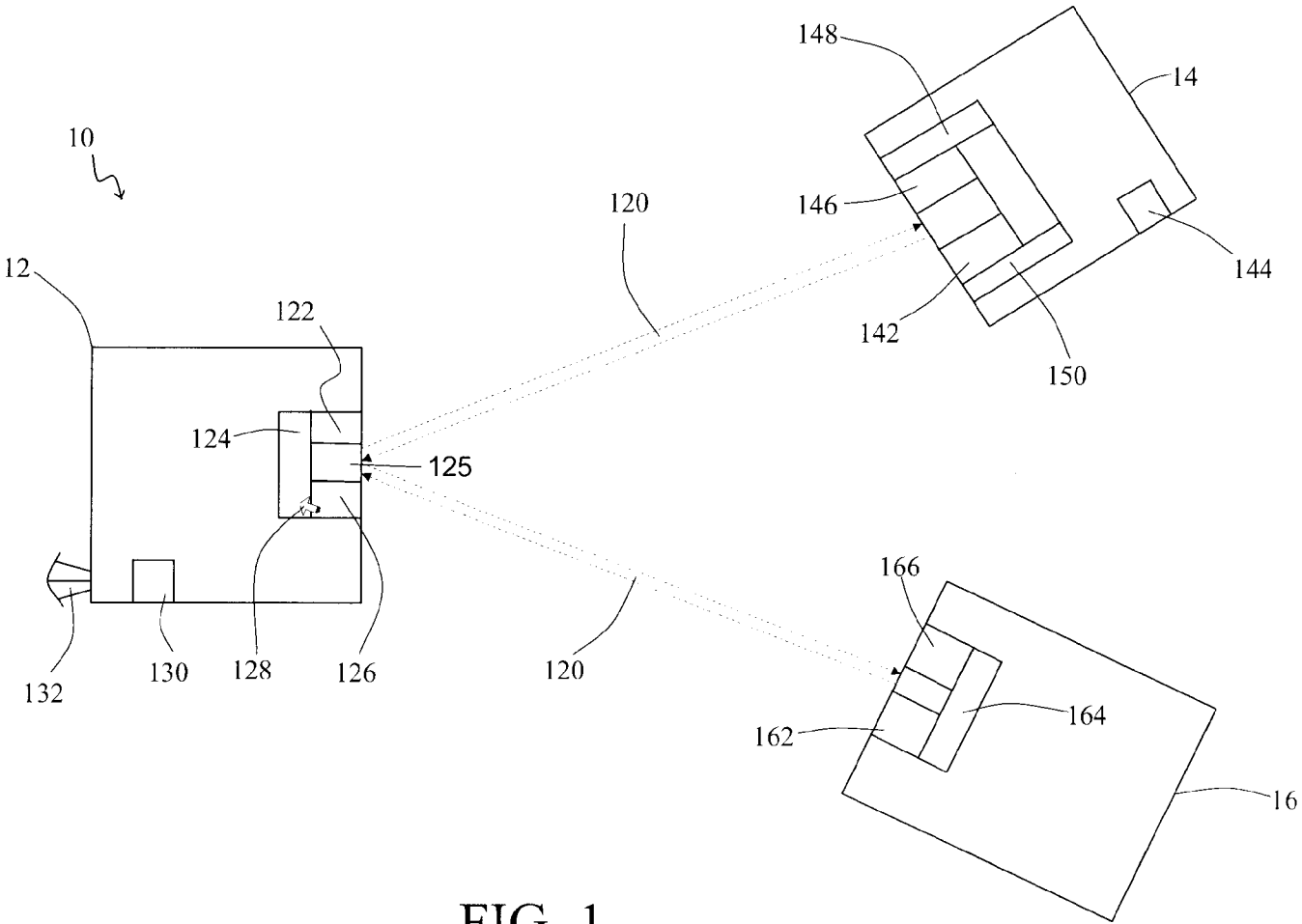
FIG. 1 is a block diagram showing the primary components of an embodiment of the invention.

Referring now to FIG. 1, one embodiment of the present invention, including an electronic article surveillance (EAS) system 10 is disclosed, the system 10 generally comprising at least one tag 12 attached to an article "A", at least one base station 14, and at least one remote 16.

In one preferred embodiment, each system 10 comprises a means for establishing an infrared (IR) communication path 120 shared between each tag 12 and each base station 14 and each remote station 16, an accurate clock generator 122, microprocessor 124, an algorithm 126 for passcode generation, infrared sensor 125 and a means for attaching tag 12 to the article. Each tag 12 is automatically assigned a default passcode 128 at the time of manufacture.

It is further envisioned that each tag 12 generates a signal 130 detectable by an interrogation unit, including interoperability with existing EAS systems. While most commercially available EAS systems operate on a frequency of 58 kHz, other arrangements are also possible, and the present invention is not limited to any particular frequency. This signal may be generated by any of the known methods, such as by means of a resonator or a ferrite located in the tag or transponder, typical of conventional electronic article surveillance markers.

In one embodiment, as further shown by FIG. 1, it is further envisioned that each tag 12 comprises a self-contained alarm 132 that may be actuated by: (a) a signal generated by an EAS antenna system at the retail exit in the event of a shoplifting event; (b) tampering of the tag 12, or by (c) being released from the article to which it is attached by a detacher that is not compatible with the IR system. Additionally, the EAS antenna system that generates the interrogation zone can alarm as well, as per conventional use in EAS systems.

Each base station 14 may comprise an accurate clock generator 142, microprocessor 144, algorithm 146 for passcode generation, tag erase function 148, USB port for function configuration 150, and the capability to communicate via infrared communication path 120. In some embodiments, base station 14 can run software capable of performing database functions for tracking tag passcodes, operating a detacher and configuring tags 12 and remotes 16, and can generally operate at the level of a typical PC running a specialized application.

Each remote 16 comprises an accurate clock generator 162, microprocessor 164, and algorithm 166 for passcode generation.

In addition to infrared communication between the tags and the base station 14 and remote station(s) 16, it is important that the system facilitates communication between the tags 10 and a detacher unit 34. This is shown more fully in FIG. 2 which shows IR communication means 120 communicating between tag 10, detacher 34 and base station 14. In this diagram, the base station is shown as being a stand-alone computer, which is one potential embodiment, although other arrangements for a base station 14 are also possible. A person of ordinary skill in the art would understand how to utilize prior art microprocessor technology of various types to achieve the base station capabilities. In some embodiments, the base station 14 and detacher 34 may be integrally incorporated into one piece of equipment such as to utilize the same clock generator 142, algorithm 146 for passcode generation and tag erase function 148. Likewise, in other embodiments, the detacher unit 34 may be separate from the base station 14 in which it will be necessary that the detacher unit 34 have its own synchronized clock, passcode generator algorithm and tag erase function.

In one embodiment, the IR communication means 120 provides communication between each tag 12 and each base station 14, remote 16, and detacher 34 respectively. Communication means 120 enables the base station 14 or remote 16 or detacher 34 to read information from and communicate and/or write information to each tag 12. The path 120 enables each tag 12, base station 14, remote 16 and detacher 34 to effectively communicate concerning the accurate clock generator 122 and its cooperative relationship with the passcode 128 and algorithm 126 generating the passcode 128. In this manner, the path 120 facilitates the exchange of information important in activating, resetting or deactivating each tag 12.

In some embodiments of the present invention, the accurate clock generator 122 of tag 12 operates in synchronicity with one or all of the accurate clock generators 142 (associated with base station 14) and 144 (associated with remote 16), respectively. The generators 122, 142 and/or 162 cooperatively synchronize so that each component is accurately detecting the same clock time. In the event that the detacher has its own accurate clock generator separate from the base station, the synchronization feature will apply to that clock as well. The passcode 128 of each tag 12 is periodically altered or changed by the algorithm 126 in accordance with a determined interval of time (e.g. 30 minute intervals). Thus, each tag 12 may be programmed so that the algorithm 126 alters or changes the passcode 128 every 30 minutes, for example, thereby minimizing the opportunities for theft of an article through passcode manipulation or by-pass. As such, the accurate clock generators 122, 142, 162 and any detacher clock generator enable the base station 14, remote 16 and detacher 34 to detect the passcode 128 of each tag 12, and if necessary or desired, alter or change the passcode 128 or completely erase the passcode at the point of interaction, temporarily disabling the tag 12.

Each base station 14 may provide at least two desirable functions. First, the base station 14 may permit resetting of the tag 12 parameters existing at the moment, including parameters previously input for the accurate clock generator, microprocessor, and passcode. The passcode may be altered or changed to a passcode or series of codes assigned by the store or business utilizing the system. Secondly, the base station 14 may be utilized to confirm tag parameters, such as status or passcode/code(s).

Figure 2:
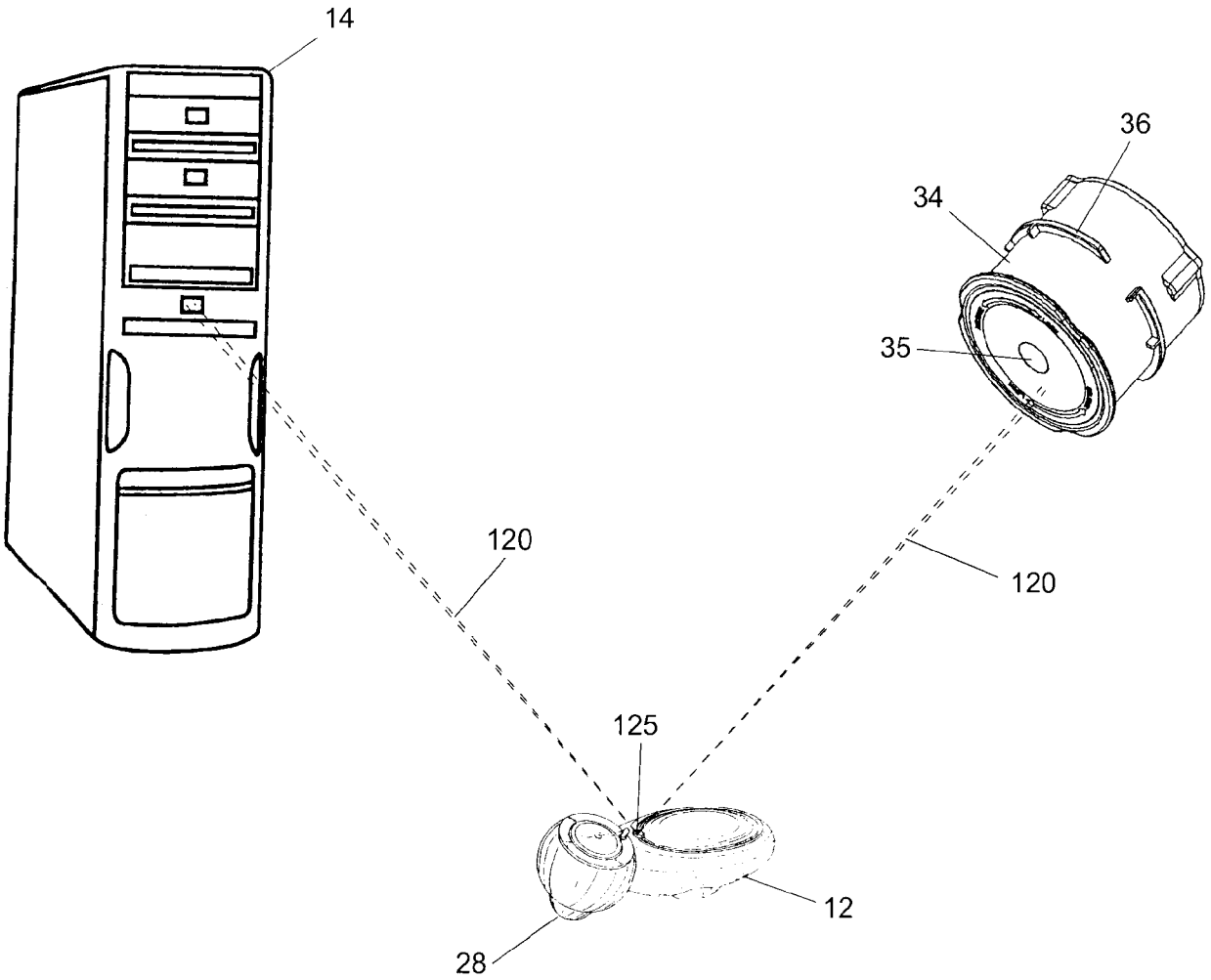
FIG. 2 is a diagram identifying the three primary components that communicate via infrared signaling in an embodiment of the present invention.
Figure 3:
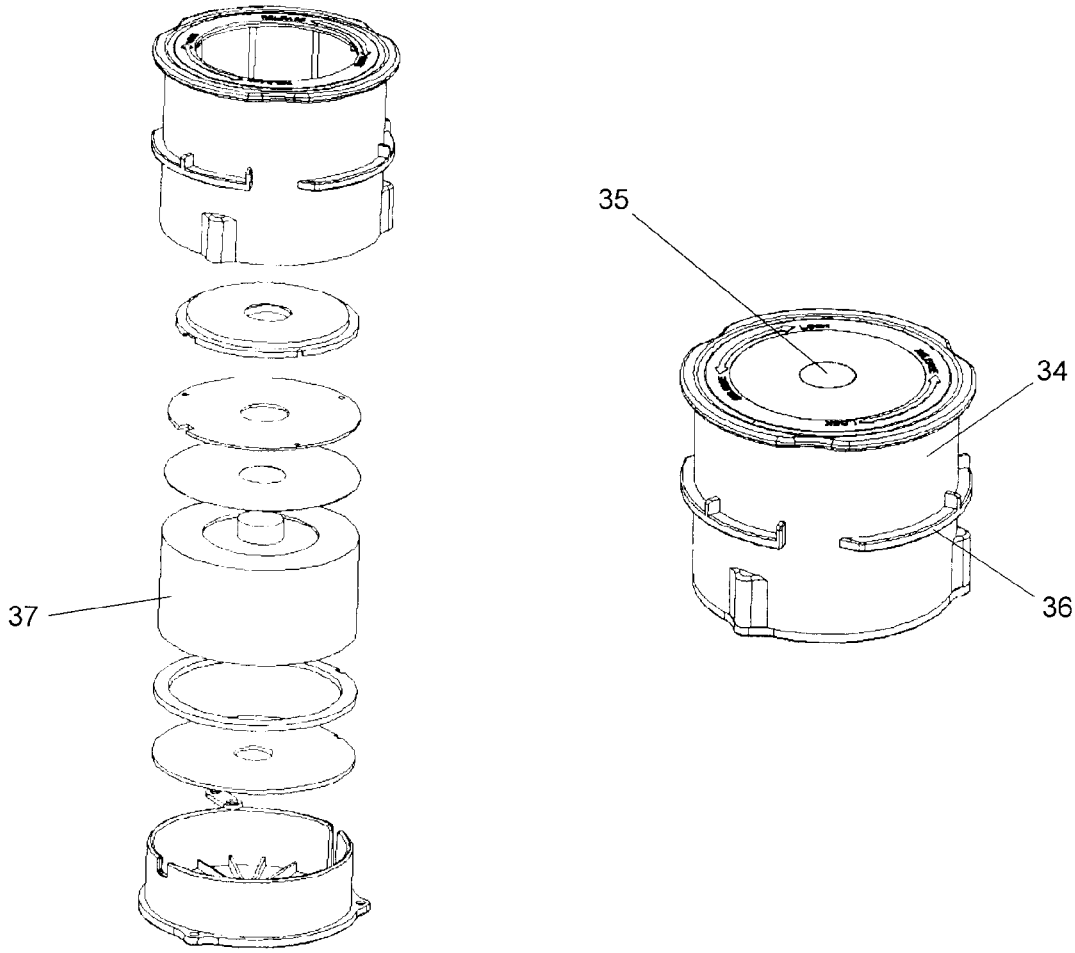
FIG. 3 is a detail drawing of a detacher module for an embodiment of the present invention.

FIG. 3 is a detail drawing of detacher module 34 for an embodiment of the present invention. Detacher 34 serves the function of providing the means for removing tag 12 from the protected article at the checkout counter. In this embodiment, detacher 34 features a communication port 35 whereby an infrared signal is generated such as to communicate with tag 12. Detacher 34 also features a strong magnet 37 which is needed to apply magnetic force to the clutch cone 28 on tag 12 (as shown in FIG. 2), thereby serving to release the pin (not shown in drawing) from tag 12, releasing the protected item. Accordingly, in order to release tag 12, both functions may be performed by detacher 34. The infrared sensor 35 of detacher 34 communicates with infrared sensor 125 of tag 12 (FIG. 2) in order to enable a successful deactivation. In addition, a magnetic force is applied to actually release the physical pin from the tag. In this regard, the EAS system of the present invention is much more secure than conventional EAS systems in that two separate actions must be performed before a release can occur. This process prevents the scenario in which a thief is able to smuggle a large magnet into the store to remove tags from merchandise. If such tags are removed at a location away from the infrared communications path 120, the tag 12 will still self alarm.

Figure 4:
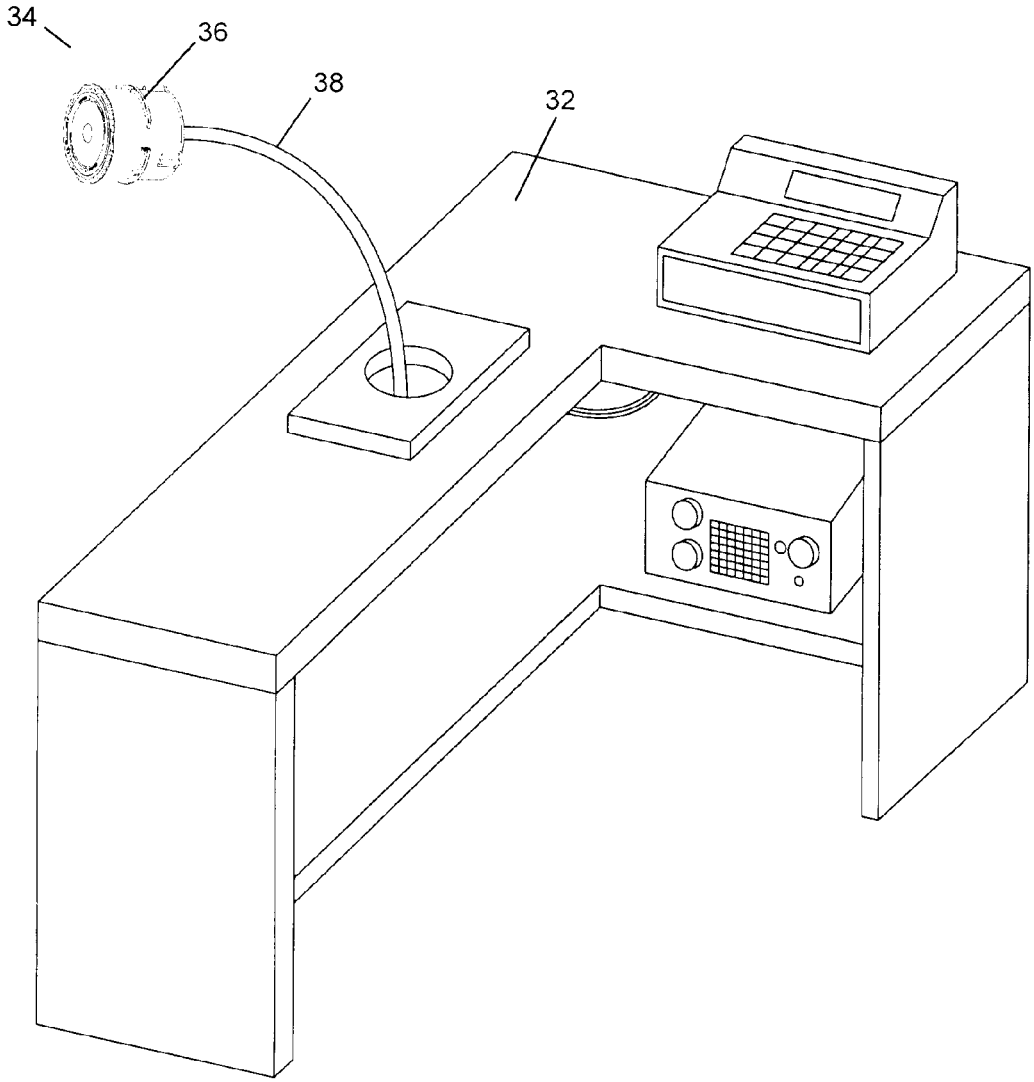
FIG. 4 is perspective view of a typical arrangement of a deactivator module for an embodiment at a typical retail checkout counter.

In another embodiment, the detacher 34 may be generally canister shaped as shown in FIG. 3 and FIG. 4. As shown in FIG. 2 and FIG. 3, detacher 34 is surrounded by a locking flange 36 that serves to enable detacher 34 to be engaged into the retail counter such that it will be flush mounted for case of operation. The shape of detacher 34 along with locking flange 36 facilitates the easy removal of detacher 34 from the counter 32. Further, detacher 34 can be placed into a spring-biased sleeve within counter 32 to keep it more secure during use, and to facilitate its removal from the counter 32.

Referring to FIG. 4, the magnetic detacher 34 is normally set into counter 32 but in yet another embodiment, it also has the ability to be removed from its mounting to facilitate tag communication and detachment of articles that are too cumbersome to be placed on the counter top. The detacher 34 is connected via tether 38 to prevent it from being removed and carried away altogether from the counter 32. Detacher 34 will also feature communication with base station 14 that may take the form of hard wiring. (not shown in the drawings) The detacher 34 may also include a self-alarm that is actuated by removal from tether 38, such as if the tether is disconnected or severed in some manner.

The remote 16 may be directionally aligned with the tag 12, such as by a user pointing the remote 16 at the tag 12. In this manner, it is envisioned that the remote 16 may read the tag passcode status and may also program the tag 12 with a new passcode. In a further alternative embodiment, remote 16 may remain active for only a defined period of time (e.g. 30 minutes), after which all stored data may be automatically deleted. The remote 16 may be taken back to the base station 14 to have data refreshed. By this feature, the remote 16 has temporary usefulness, which serves as a protection against the misplacement or theft of the remote 16 by causing the remote 16 to be useless for anyone trying to steal articles in the same store or another store utilizing the same model system.

The alarm 132 may be independent of the alarm generated in response to tag 12 detection by the regular EAS antenna system within the respective interrogation zone. The sensitivity of the alarm 132 may be adjustable or preset, depending upon preference, so that attempted removal of the tag 12 from an article, or a separation of one or more of the components of the tag 12, actuates the alarm 132 at the point of tampering. Alternatively, the sensitivity may be adjustable or preset, depending upon preference, so that actual removal of the tag 12, or separation of one or more of the components of the tag 12, actuates the alarm 132 at the point of tampering. Under either circumstance or condition, if sufficient tampering or successful removal of the tag 12 is achieved, the alarm 132 may generate an alarm signal detectable by security personnel or assigned personnel.

Figure 5:
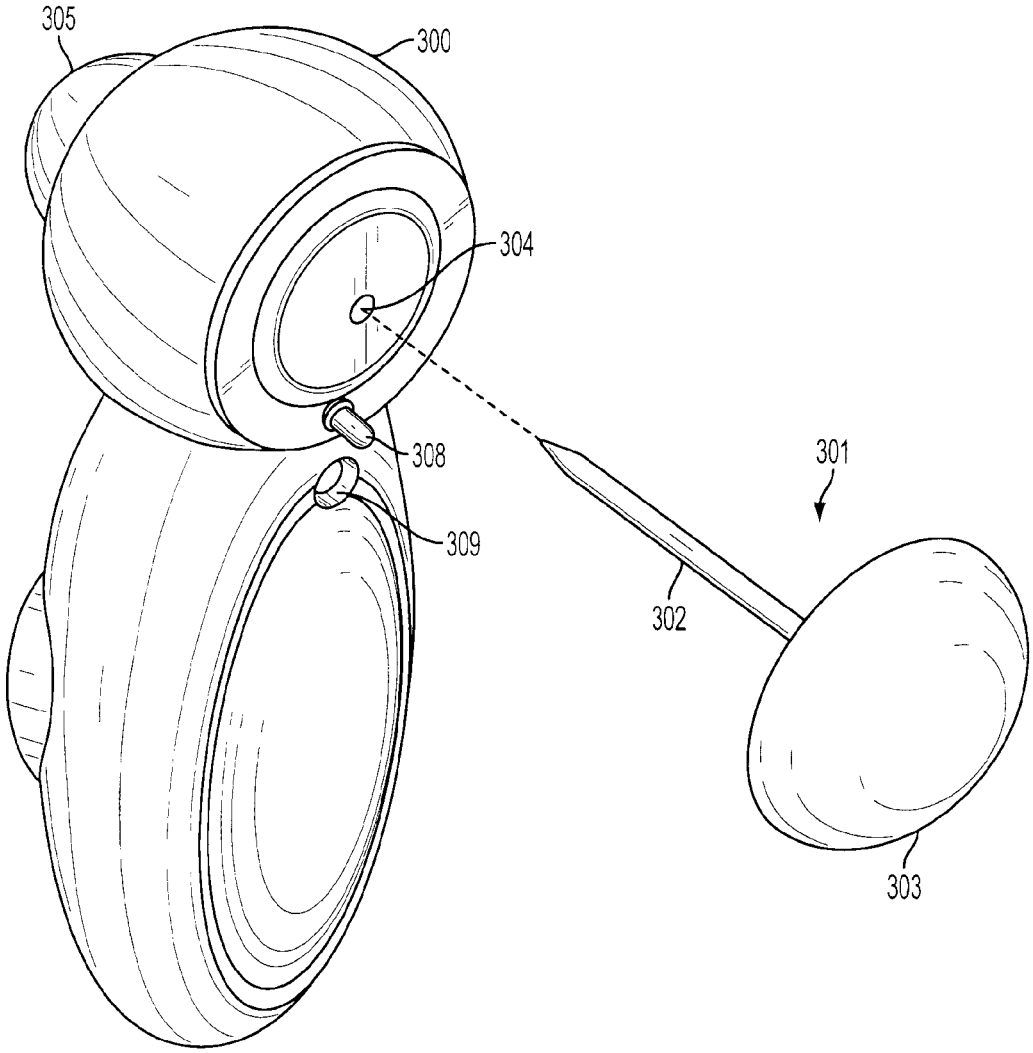
FIG. 5 is an external perspective view of an EAS hard tag with infrared communications capability as per an embodiment of the present invention.
Figure 6:
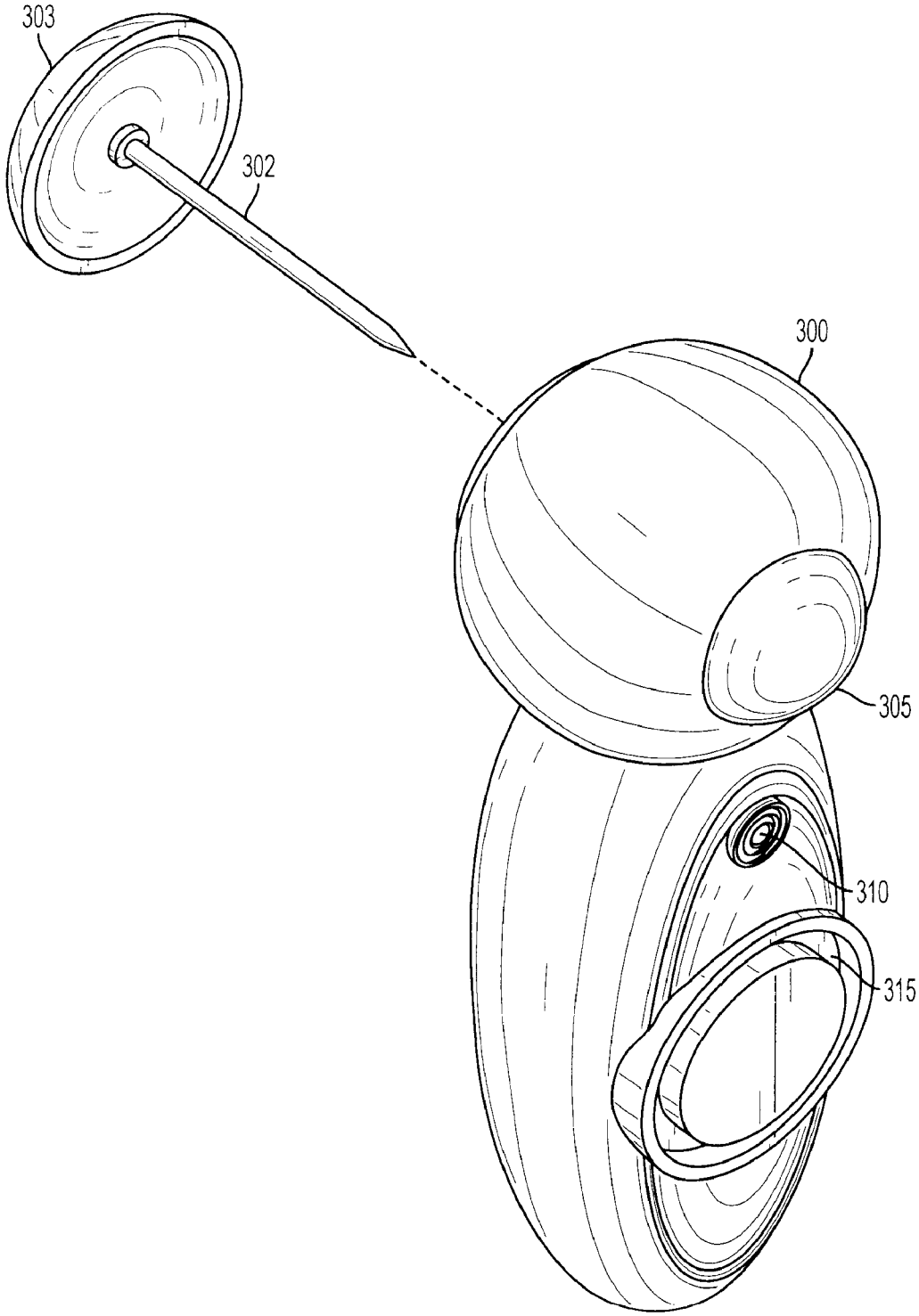
FIG. 6 is an alternative external view of an EAS hard tag with infrared communications capability as per an embodiment of the present invention.

FIGS. 5 and 6 show external perspective views of an embodiment of a tack retained tag 300. Tack 301 has a shaft 302 and head 303. To retain tag 300 on an article, tack shaft 302 is passed through the article and into aperture 304, shown in FIG. 5. Tack 301 is releasably retained by a mechanism located in tag 300. In one embodiment of tag 300, the mechanism that retains tack shaft 302 in aperture 304 is a ball clutch mechanism which can be made to release tack shaft 302 by application of a strong magnetic force to clutch cone 305. Another type of mechanism uses sliding wedges 306, visible in FIG. 7, to retain tack shaft 302. This embodiment can also be made to release tack shaft 302 by application of a strong magnetic force to clutch cone 305. In some embodiments, clutch housing 307, visible in FIG. 7, has at least some magnetically attractable material within it, and is the element acted upon by the strong magnetic force to release the tack shaft 302.

Figure 7:
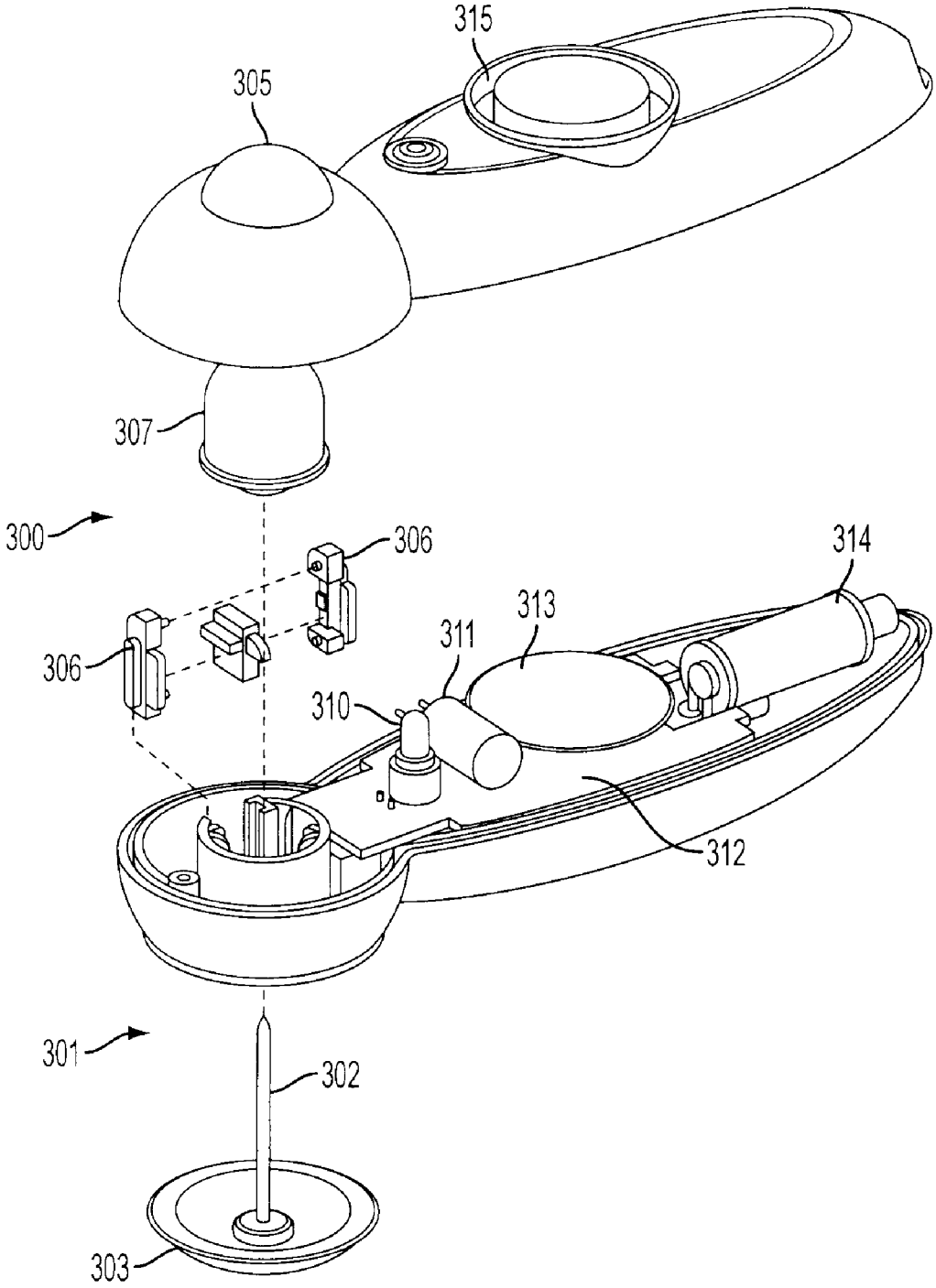
FIG. 7 is an exploded perspective view of the internal components of an EAS hard tag with infrared communications capability as per an embodiment of the present invention.

Depending on the specific embodiment, tag, or transponder 300, may have several more features or elements in addition to those already discussed. Visible in FIG. 5 are possible elements switch button 308 and an infrared communication port 309. Visible in FIG. 7 are additional possible elements including; a light emitting diode (LED) 310, battery 311, circuit board 312 with microprocessor, clock, and communication antenna components (microprocessor, clock, and communication antenna components are not visible in FIG. 7), audible alarm generator 313, and EAS ferrite 314. While the embodiment of tag 300 shown in FIG. 7 has an EAS ferrite 365, other embodiments might use a resonator, which is a common detectable element used in EAS tags. Another possible element that may accompany audible alarm generator 313, is sound vent 315, most visible in FIGS. 6 and 7. Sound vent 315 allows the alarm to be more audible by allowing a path for sound to leave tag 300.

In a preferred embodiment, tag 300 is capable of self-alarming upon the occurrence of any one of several events. One event that can trigger self-alarming by tag 300 is physical tampering with the tag. If tack 301 is forcibly removed or if tack head 303 is pried off of tack shaft 302, tag 300 will alarm with audible alarm generator 313 generating a loud audible sound. Switch button 308, which is spring-biased outward and visible in FIG. 5, is depressed by tack head 303 when tack shaft 302 is inserted into tag 300. If tack 301 is forcibly removed or if tack head 303 is pried off of tack shaft 302, switch button 308 is released from its depressed position causing tag 300 to self-alarm. Some embodiments of tag 300 will self-alarm when the body of tag 300 is opened or otherwise compromised. In this case, the self-alarm may be triggered by the displacement of circuit board 312 or other means.

All in all, there are several ways that various embodiments of tag 300 can generate alarms. Tag 300 can self alarm with its onboard audible alarm generator 313 when tampered with. Tag 300 can self alarm with its onboard audible alarm generator 313 if it is detached from an article without first being deactivated. Tag 300 can self alarm with its onboard audible alarm generator 313 when it detects that an onboard electronic article surveillance element such as ferrite 314, or a resonator, is being stimulated by an electronic article surveillance interrogation zone. An electronic article surveillance system itself can also generate a system alarm when it detects the presence of a tag 300 having an electronic article surveillance ferrite, or resonator, 314.

Figure 8:
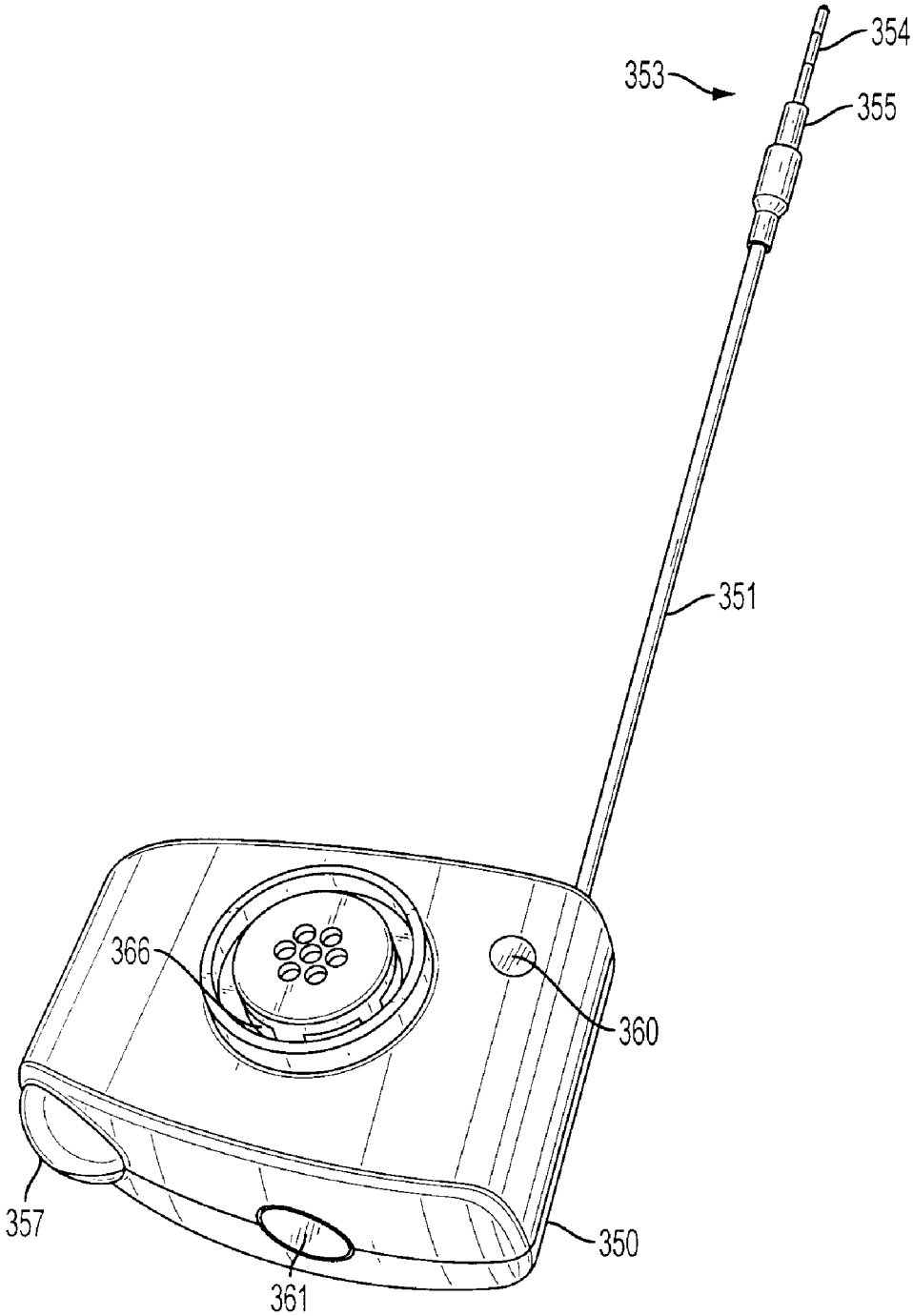
FIG. 8 is a detailed perspective view of an EAS lanyard tag with infrared communications capability as per a preferred embodiment of the present invention.
Figure 9:
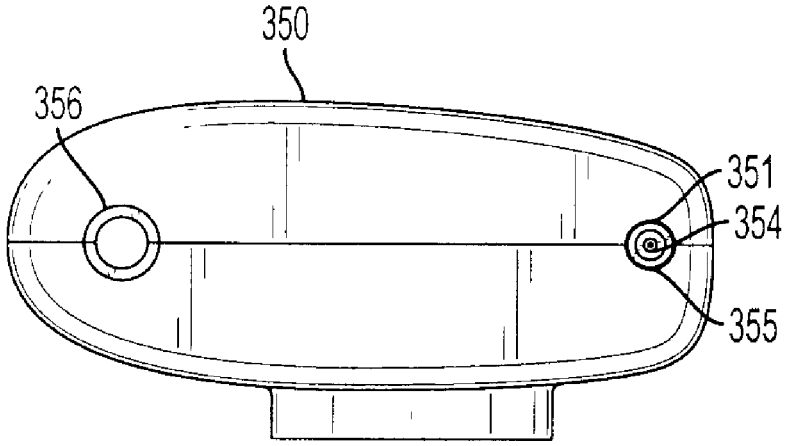
FIG. 9 is a detailed top view of an EAS lanyard tag with infrared communications capability as per an embodiment of the present invention.
Figure 10:
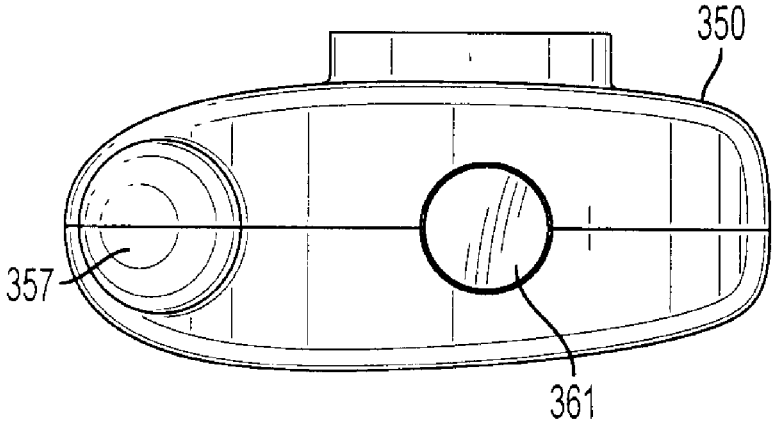
FIG. 10 is a detailed bottom view of an EAS lanyard tag with infrared communications capability as per an embodiment of the present invention.
Figure 11:
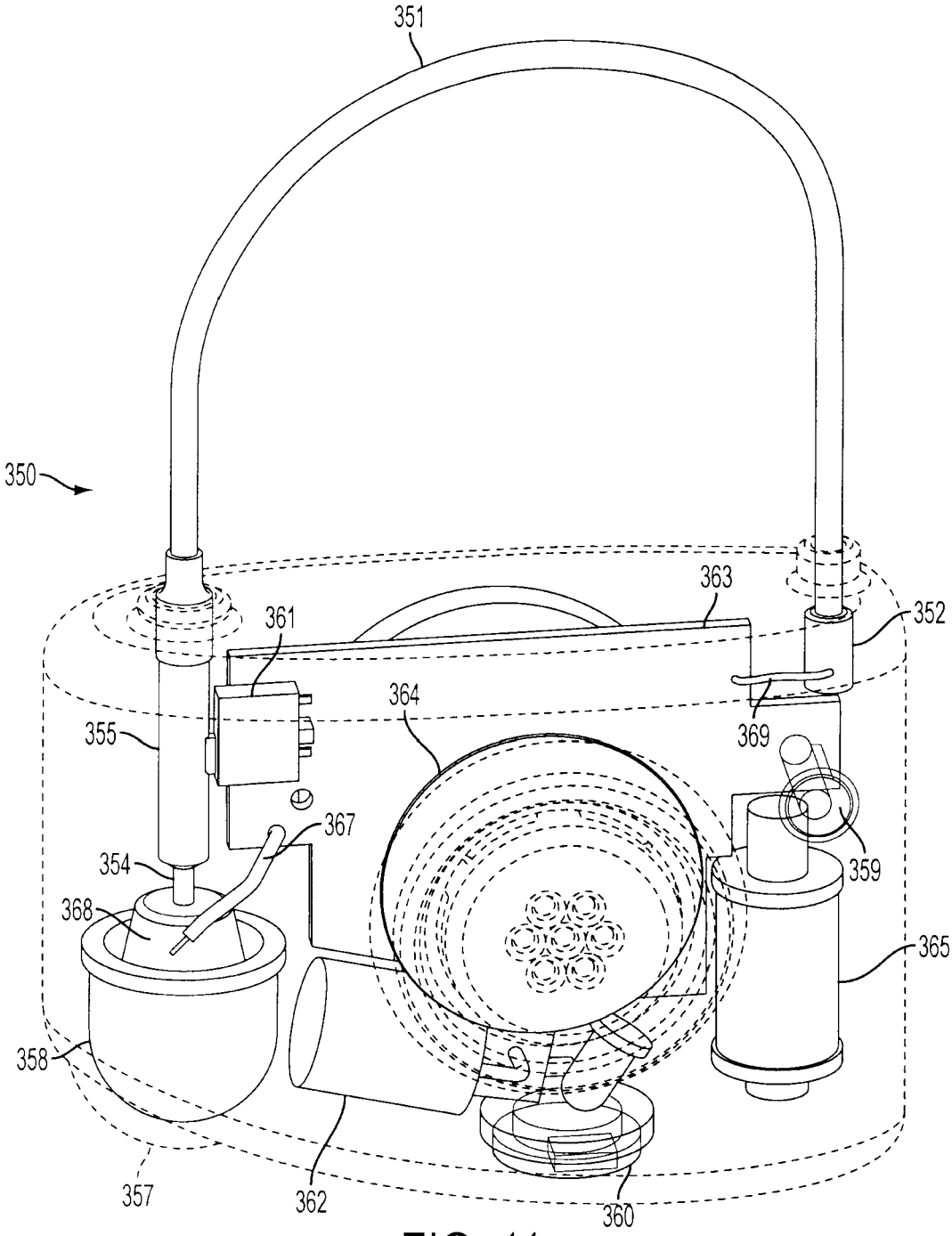
FIG. 11 is an internal view of an EAS lanyard tag with infrared communications capability as per an embodiment of the present invention.

FIG. 8 shows an external perspective view of an embodiment of a lanyard retained tag, or transponder 350, while FIGS. 9 and 10 show top and bottom views of lanyard tag 350, respectively. FIG. 11 shows internal components of lanyard tag 350. Lanyard 351 has a permanently anchored end and a coupler end 353, and, in some embodiments, along its length, some portion of lanyard 351 is made of an electrically conductive material. In particular, many embodiments of lanyard tag 350 will have a lanyard 351 having its core made of an electrically conductive cable. Coupler end 353 of lanyard 351 has a retention pin section 354 and a contact cylinder section 355. To retain lanyard tag 350 on an article, lanyard 351 is passed through the article and retention pin 354 is inserted into aperture 356 (shown in FIG. 9), where it is retained by a mechanism located in lanyard tag 350. Alternatively to passing lanyard 351 through an article, lanyard 351 may be passed around some location on an article where it may not be easily removed. In one embodiment of tag 350, the mechanism that retains retention pin 354 in aperture 356 is a ball clutch mechanism which can be made to release retention pin 354 by application of a strong magnetic force to clutch cone 357 visible on the bottom of lanyard tag 350 in FIGS. 8, 10, and 11. In some embodiments, clutch housing 358, visible in FIG. 11, has at least some magnetically attractable material in it, and is the element acted upon by the strong magnetic force to release retention pin 354.

Depending on the specific embodiment, lanyard tag, or lanyard transponder 350, may have several more features or elements in addition to those already discussed. Visible externally in FIG. 8 are two possible elements; an infrared communication port 359 and a light emitting diode (LED) 360. Infrared communication port 359 and LED 360 are also visible in FIG. 11, while only LED 360 is visible in FIG. 10. Visible in FIG. 11 are additional possible elements internal to lanyard tag 350. These additional possible internal elements include; switch 361, battery 362, circuit board 363 with microprocessor, clock, and communication antenna components (microprocessor, clock, and communication antenna components are not visible in FIG. 11), audible alarm generator 364, and EAS ferrite 365. While the embodiment of lanyard tag 350 shown in FIG. 11 has an EAS ferrite 365, other embodiments might use a resonator, which is a common detectable element used in EAS tags. Another possible element that may accompany audible alarm generator 364, is sound vent 366, most visible in FIG. 8. Sound vent 366 allows the alarm to be more audible by allowing a path for sound to leave tag 350. Finally, clutch wire 367 runs from circuit board 363 to retention element 368, and lanyard wire 369 runs from circuit board 363 to anchored end 352 of lanyard 351. Clutch wire 367, lanyard wire 369, lanyard 351 and switch 361 form circuits that assist with detecting physical tampering with lanyard tag 350, as more fully explained below.

Lanyard tag 350 is capable of self alarming upon the occurrence of any one of several events. One event that can trigger self alarming by tag 350 is physical tampering with the tag. A common attack used against lanyard type tags is the cutting of the lanyard. Referring to FIGS. 8 and 11, once coupler end 353 of lanyard 351 is inserted through aperture 356 and into retention mechanism 368, two tamper detection circuits are completed. A first tamper detection circuit includes clutch wire 367, retention mechanism 368, retention pin 354, contact cylinder 355, and switch 361 and is completed on circuit board 363 (microprocessor, etc.). This first tamper detection circuit establishes that coupler end 353 of lanyard 351 has been inserted. A second tamper detection circuit includes lanyard wire 369, lanyard 351 and can be completed by two possible routes. One completion route includes contact cylinder 355, switch 361, and circuit board 363 (microprocessor, etc.). Another completion route includes retention pin 354, retention mechanism 368, clutch wire 367 and circuit board 363 (microprocessor, etc.). This second tamper detection circuit monitors the integrity of lanyard 351. If lanyard 351 is cut, the first tamper detection circuit is still completed, while the second detection circuit is opened. When tag 350 detects that lanyard 351 has been cut, it self alarms with audible alarm generator 313 generating an audible sound. Some embodiments of tag 350 will self alarm when the body of tag 350 is opened or otherwise compromised. In this case the self alarm may be triggered by the displacement of circuit board 363 or other means.

A sophisticated thief may seek to defeat a lanyard type tag 350 by bringing a strong magnet into the retail establishment to apply to the portion of the tag corresponding to the ball clutch mechanism at the bottom of the lanyard tag 350. However, in such a situation, where an appropriately passcoded IR signal has not been received, the removal of lanyard 351 from socket 356 will result in a self alarming of the tag, thereby exposing the theft effort.

A further event that may cause some embodiments of tag 350 to self alarm is interaction with a standard electronic article surveillance system through ferrite 365, or a resonator, in some embodiments. If merchandise bearing lanyard tag 350 are attempted to be smuggled out of the retail establishment, the ferrite 365 or comparable resonator will self alarm, and will likewise set off an alarm by the EAS system itself. Detection of tag 350 by an article surveillance system will cause the article surveillance system to generate a system alarm, audible or otherwise. However, the activity in ferrite 365 is also detectable by circuit board 363 which can trigger a self alarm by tag 350.

All in all, there are several ways that various embodiments of tag 350 can generate alarms. Tag 350 can self alarm with its on board audible alarm generator 364 when tampered with. Tag 350 can self alarm with its onboard audible alarm generator 313 if it is detached from an article without first being deactivated. Tag 350 can self alarm with its on-board audible alarm generator 364 when it detects that an onboard electronic article surveillance element such as a ferrite 365, or a resonator, is being stimulated by an electronic article surveillance interrogation zone. An article surveillance system can also generate a system alarm when it detects the presence of a tag 350 having an electronic article surveillance ferrite, or resonator, 365.

In other embodiments, a microprocessor 144 (FIG. 1) located in tags such as tag 12 in FIG. 1, hard tag 300 (FIG. 7) or lanyard tag 350 (FIG. 11), and other embodiments, is capable of storing information, being reprogrammed, and performing functions through other elements as discussed as being in tag 300 and lanyard tag 350. The microprocessor can store a wide range of information communicated to it by supporting systems via radio signals, infrared signals, etc. For example, when a tag is attached to an article, information about that article can be transmitted to the tag and stored. In some embodiments, other, particularly important, pieces of information that a microprocessor might store includes a passcode. The passcode may initially be assigned at a factory and may be altered on location when put into use. When queried by a system, the microprocessor responds with its ID, or other solicited information, via the tag's communications elements, infrared port, etc. As explained, in embodiments employing a passcode, the passcode can provide additional security in conjunction with the unique identifier, or ID, by adding an additional system element wherein a device used to detach or disarm a tag, or to instruct a tag to stop self alarming, must be able to verify a passcode to be able to execute the operation. For example, as discussed above, some transponders may be released from an article to which they are attached by the application of a strong magnetic force. Without the need for verification from the EAS system, a transponder can be detached by the application of a large unauthorized magnet. Requiring interaction with the system, such as passcode verification, before detaching the tag allows the microprocessor to be programmed to alarm when it is detached with no system interaction or passcode exchange.

Transponder embodiments employing a passcode may a have a static, unchanging passcode or may employ a changeable passcode. Passcodes that can be changed are changeable by computer via a universal serial bus (USB), by wireless infrared device, or the tag can automatically change the passcode using a time-based algorithm programmed into the tag's microprocessor. Other system elements, such as a base station will have the same algorithm as the tag and be able to duplicate and track the passcode changes for the same passcode system wide.

Embodiments using a time-based algorithm programmed into the tag's microprocessor to change the passcode will do so periodically. In one embodiment, transponders have a highly accurate clock onboard along with the microprocessor. The microprocessor is programmed with an algorithm for changing the passcode for the tag and the clock is used to determine when the passcode should be changed according to the protocols programmed into the microprocessor. The system includes a base station capable of running software. The base station also has an accurate clock and possesses the algorithm programmed into the microprocessor of the tag. By knowing the initial passcode of a tag and marking an initial time, the base station of the system can update its database to contain the correct the passcode.

Of course if the passcode of a transponder is changed directly by a base station or remote, then the passcode of that transponder is known to the other elements of the system and the database is updated at the time of the passcode change. In one system embodiment, a system wide passcode is used and no unique transponder identifiers are needed. When the passcode is changed, it is changed for all elements of the system, transponders, remotes, and base station. In an embodiment using a time based algorithm to change the passcode, all elements of the system have access to high accuracy clocks. The system elements are chronologically synchronized and the passcode is internally changed in each element. When system elements communicate, they each have the correct updated passcode.

For a transponder, or tag, using a passcode to be released from an article without generating an alarm, an element of the system, such as a base station or remote, must communicate with the transponder, confirm the passcode, and instruct the transponder microprocessor. In one embodiment, this interaction between the system and the transponder is performed through infrared communication. In these embodiments, the transponders have infrared communication ports for interaction with the system and the system elements have infrared communication capabilities. A special tool combining microprocessor and communication capabilities with the ability to generate a strong magnetic force can unlock, or detach, a transponder while altering its settings to not alarm. For those system embodiments where a single passcode is valid throughout the system, infrared (IR) communication can be more targeted than broadcasting a disarming single with radio frequency signals, since line of sight is more influential with IR communications.

What is claimed is:

1. An electronic article surveillance system comprising:

at least one tag, each tag comprising an attachment mechanism, an on-board power system, a microprocessor, and machine readable instructions encoded for storing a passcode;

at least one tag interface, each tag interface comprising, a processor, and machine readable instructions encoded for storing a passcode;

the means for establishing infrared communication between at least one tag and at least one interface to enable the interchange of information, wherein said passcode stored in said at least one tag is changeable by said at least one tag interface.

2. The electronic article surveillance system of claim 1, wherein:

said passcode stored on said tag may be changed by a tag interface via a physical connection to said tag interface.

3. The electronic article surveillance system of claim 1, wherein:

said passcode stored on each said tag may be changed by a tag interface via said infrared communication means between said tag and said tag interface.

4. The electronic article surveillance system of claim 1, wherein:

each said at least one tag further comprises an accurate clock generator, and machine readable instructions encoded for performing an algorithm for generating multiple passcodes, and wherein at a specific time each active tag possesses a passcode and uses said algorithm to create a new passcode at a specified time; and, each said tag interface further comprises an accurate clock generator and machine readable instructions encoded for performing an algorithm for generating multiple passcodes, and wherein at said specific time, each said tag interface possesses said passcode and uses said algorithm to create the same new passcode at said specified time.

5. The electronic article surveillance system of claim 1, wherein:

said attachment mechanism is a lanyard and clutch.

6. The electronic article surveillance system of claim 1, wherein:

said attachment mechanism is a tack and ball clutch, said tack comprising a shaft and a cap, said ball clutch being located within said at least one tag and retaining said tack by engaging said shaft, said shaft passing through an item to be protected and said cap maintaining said tag on said item when said shaft is retained by said ball clutch.

7. The electronic article surveillance system of claim 1, wherein:

said attachment mechanism is a clip.

8. The electronic article surveillance system of claim 1, wherein:

said tag further comprises an electronic article surveillance sensor.

9. The electronic article surveillance system of claim 8, wherein:

said electronic article surveillance sensor is a ferrite.

10. The electronic article surveillance system of claim 9, wherein:

said electronic article surveillance sensor is an electronic article surveillance resonator.

11. The electronic article surveillance system of claim 1, wherein:

said tag further comprises an audible alarm generator.

12. The electronic article surveillance system of claim 11, wherein:

said tag generates an audible alarm when said attachment mechanism is disengaged without said tag being disarmed via said infrared communication means.

13. The electronic article surveillance system of claim 11, wherein:

said tag generates an audible alarm when said tag is tampered with out said tag being disarmed via said infrared communication means.

14. The electronic article surveillance system of claim 11, wherein:

said tag generates an audible alarm when said tag enters an electronic article surveillance zone without said tag being disarmed via said infrared communication means.

15. The electronic article surveillance system of claim 8, wherein:

said tag triggers a system alarm when it enters an interrogation zone.

16. The electronic article surveillance system of claim 1, wherein:

said tag interface is a base station which manages at least a portion of the EAS system.

17. The electronic article surveillance system of claim 1, wherein:

said tag interface is a remote management unit, said remote management unit comprising a strong magnetic force generating means, an accurate clock generator, a power source, a processor, and machine readable instructions encoded for storing a passcode and for performing an algorithm for generating serial passcodes at known time intervals.

18. The electronic article surveillance system of claim 4, wherein:

said passcode is the same passcode for each tag affected by said EAS system.

19. An electronic article surveillance system comprising:

at least one tag, each tag comprising an attachment mechanism, an electronic article surveillance sensor, an alarm generator, an on-board power system, an accurate clock generator, a microprocessor, and machine readable instructions encoded for storing a passcode and for performing an algorithm for generating serial passcodes, and wherein at a specific time each active tag possesses a passcode;

at least one tag interface, each tag interface comprising, an accurate clock generator, a processor, and machine readable instructions encoded for storing passcodes and for performing an algorithm for generating serial passcodes;

an means for establishing infrared communication between each tag and each tag interface, to enable the interchange of information between each tag and each tag interface; wherein, said passcode stored in said tag can be changed via said infrared communication means, and can be changed by said microprocessor executing said algorithm periodically.

20. The electronic article surveillance system of claim 19, wherein:

said attachment mechanism is a lanyard and clutch.

21. The electronic article surveillance system of claim 19, wherein:

said attachment mechanism is a tack and ball clutch, said tack comprising a shaft and a cap, said ball clutch being located within said at least one tag and retaining said tack by engaging said shaft, said shaft passing through an item to be protected and said cap maintaining said tag on said item when said shaft is retained by said ball clutch.

22. The electronic article surveillance system of claim 19, wherein:

said attachment mechanism is a clip.

23. The electronic article surveillance system of claim 19, wherein:

said electronic article surveillance sensor is a ferrite.

24. The electronic article surveillance system of claim 19, wherein:

said electronic article surveillance sensor is an electronic article surveillance resonator.

25. The electronic article surveillance system of claim 19, wherein:

said tag generates an audible alarm when said attachment mechanism is disengaged without said tag being disarmed via said infrared communication means.

26. The electronic article surveillance system of claim 19, wherein:

said tag generates an audible alarm when said tag is tampered with out said tag being disarmed via said infrared communication means.

27. The electronic article surveillance system of claim 19, wherein:

said tag interface is a base station which manages at least a portion of said EAS system.

28. The electronic article surveillance system of claim 19, wherein:

said tag interface is a deactivator.

* * * * *